United States Patent [19]

Werner

[11] Patent Number: 4,882,882

[45] Date of Patent: Nov. 28, 1989

[54] FORM FOR A MORTAR CAP

[76] Inventor: Ronald Werner, 12-204 Dell Pl., Stanhope, N.J. 07874

[21] Appl. No.: 177,086

[22] Filed: Apr. 4, 1988

[51] Int. Cl.[4] ..... E02D 29/14

[52] U.S. Cl. ..... 52/21; 52/427

[58] Field of Search ..... 52/19, 20, 21, 743, 52/127.3, 127.4, 127.6, 749, 426, 427; 249/4, 19, 22, 33

[56] References Cited

U.S. PATENT DOCUMENTS

| | | | |
|---|---|---|---|
| 1,226,214 | 5/1917 | Hopkins | 52/427 X |
| 1,459,344 | 6/1923 | Rasmussen | 52/427 |
| 1,554,833 | 9/1925 | Armstrong | 249/140 |
| 1,948,931 | 2/1934 | Mears | 249/90 |
| 3,063,122 | 11/1962 | Katz | 249/157 |
| 3,395,884 | 8/1968 | Laukala | 249/216 |
| 4,187,648 | 2/1980 | Hahn | 52/21 |
| 4,709,526 | 12/1987 | Crumby | 52/749 |

FOREIGN PATENT DOCUMENTS

| | | | |
|---|---|---|---|
| 2145444 | 3/1985 | United Kingdom | 404/26 |

*Primary Examiner*—David A. Scherbel
*Assistant Examiner*—Creighton Smith
*Attorney, Agent, or Firm*—Bernard J. Murphy

[57] ABSTRACT

The mortar cap receives cementitious materials therewithin, such as cement, mortar, and the like, to define a footing for a catch basin grating, and has a base frame with parallel, spaced-apart walls, and an ancillary frame also with parallel, spaced-apart wall. The base frame is set within the ancillary frame, and the latter is slidably and vertically displaceable relative to the base frame. The ancillary frame has a plurality of knobs projecting from wall surfaces thereof which confront given wall surfaces of the main frame, and the given wall surfaces of the main frame has a plurality of racks of ribs. With vertical displacement of the ancillary frame, relative to the main frame, the knobs engage the ribs and, as a consequence, the ancillary frame is arrestingly held in the displacement.

10 Claims, 2 Drawing Sheets

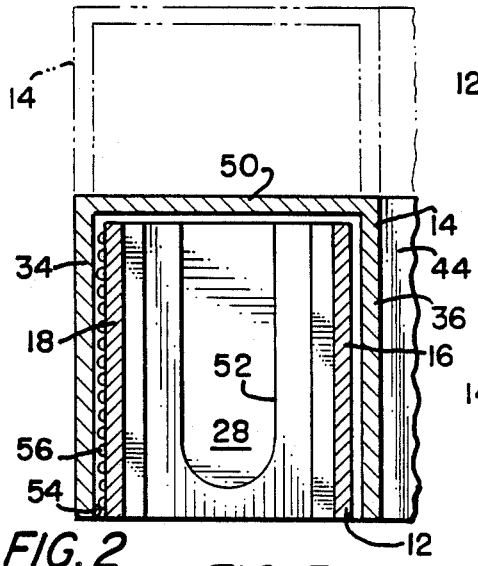
FIG. 2
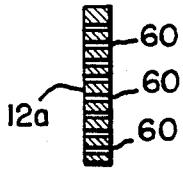
FIG. 8
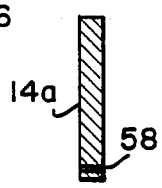
FIG. 9
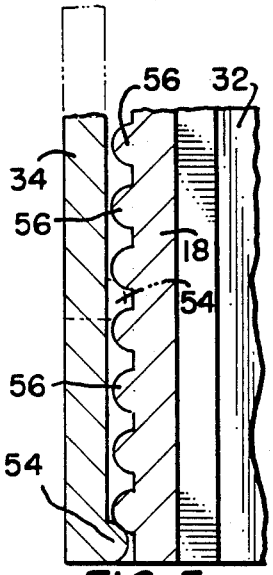
FIG. 5
FIG. 3
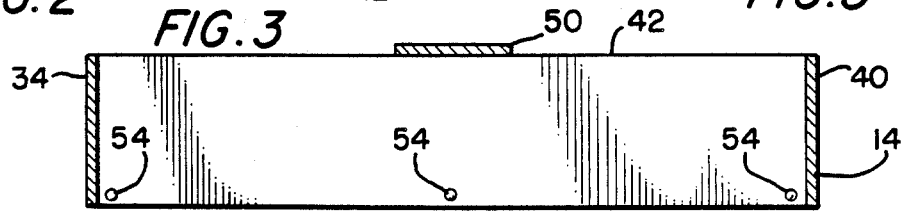
FIG. 4
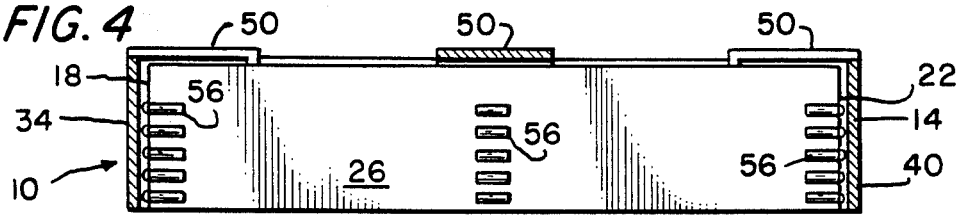
FIG. 6
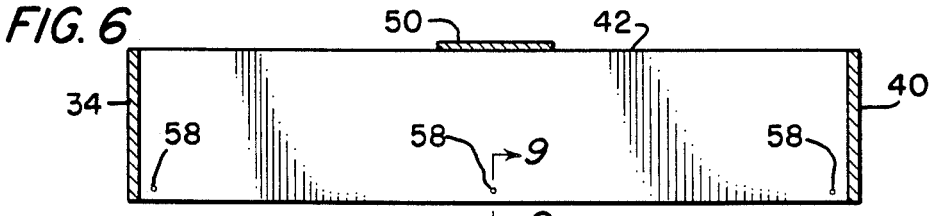
FIG. 7
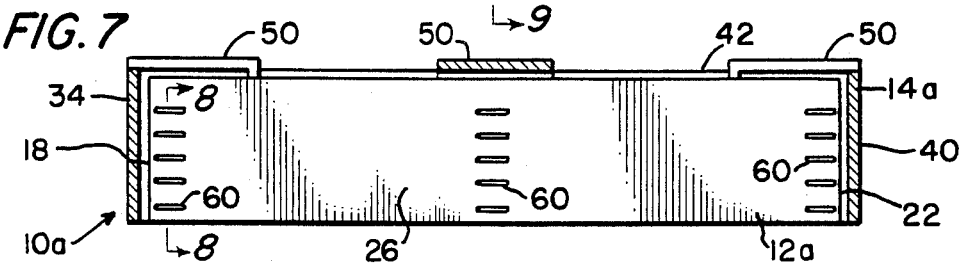

FORM FOR A MORTAR CAP

This invention pertains to forms for the receipt therewithin of cementitious materials, such as cement, mortar, and the like, for forming structures, and in particular to forms for mortar caps in which to form footings for catch basin gratings.

Such mortar cap forms are known in the prior art, and exemplary thereof is the "Form for a Mortar Cap", disclosed in U.S. Pat. No. 4,187,648, by Raymond F. Hahn, which patent issued on Feb. 12, 1980. The patented mortar cap is quite adequate to the purposes thereof. However, where it is necessary to accommodate a sloped or tilted attitude for a catch basin mortar cap, the Hahn invention requires the use of supplementary forms which must be latched to the basic form. For each angle or slope, then, it is necessary to have a given supplementary form. This escalates the expense of catch basin repair, and requires the stocking of a great number of diverse angle supplementary forms.

What has long been sought is a single article of manufacture which possesses the ability to adjust for angle, slopes and/or tilts, and in which to pour cementitious materials to create a mortar cap, for a catch basin grating, or the like, at just such angle, or slope, or tilt.

It is an object of this invention, then, to set forth just such a long-sought form for a mortar cap. It is particularly an object of this invention to disclose a form for a mortar cap, for receiving cementitious materials therewithin, such as cement, mortar, and the like, to define a footing for a catch basin grating, comprising a base frame having parallel, spaced-apart walls; and an ancillary frame also having parallel, spaced-apart walls; wherein said base frame is set within said ancillary frame; and said ancillary frame is slidably and vertically displaceable relative to said base frame.

Further objects of this invention, as well as the novel features thereof, will become more apparent by reference to the following description taken in conjunction with the accompanying figures, in which:

FIG. 2 is a cross-sectional view, taken along section 2—2 of FIG. 1, in a scale greatly enlarged over that of FIG. 1;

Figure 1:
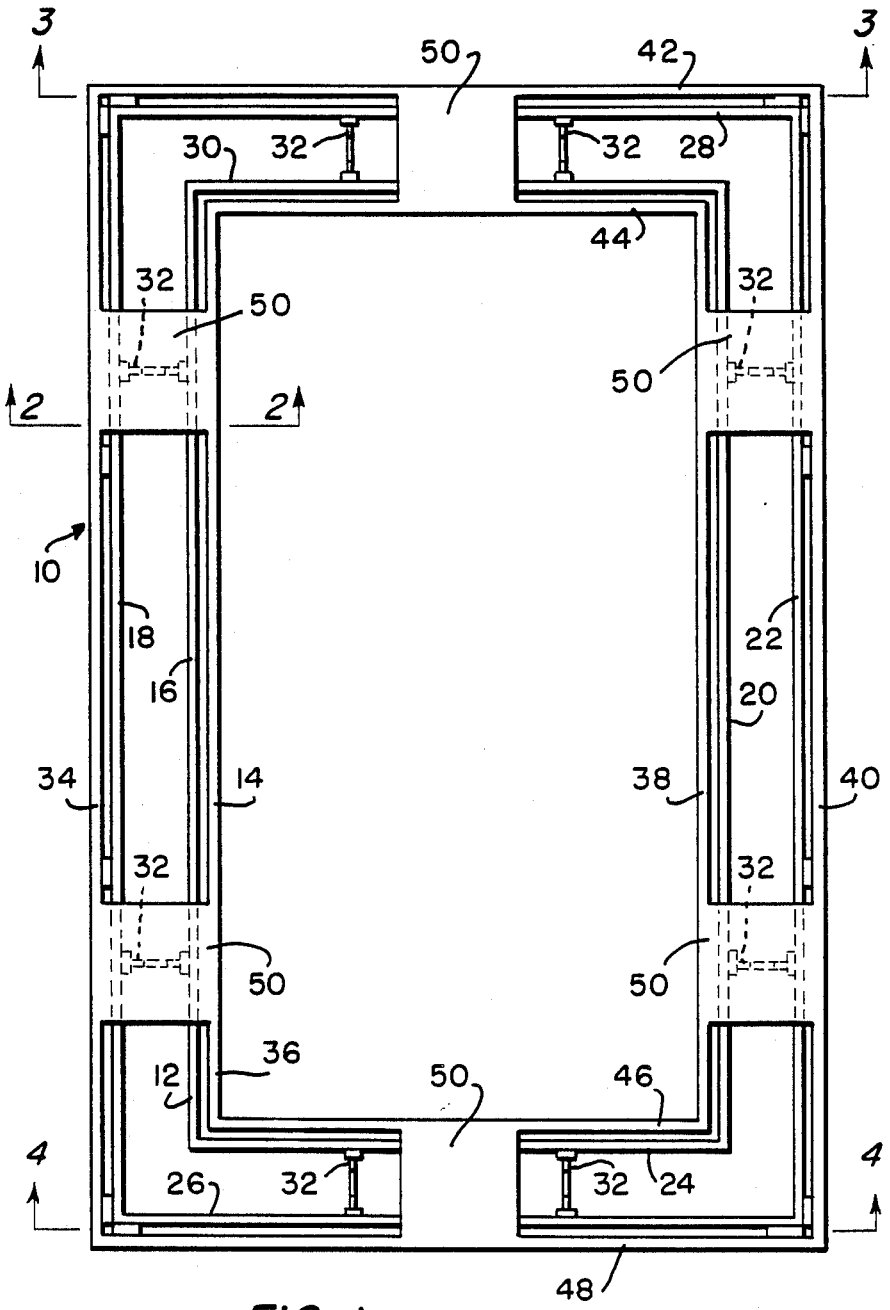
FIG. 1 is a plan view of the novel form for a mortar cap, according to an embodiment of the invention.

FIGS. 3 and 4 are cross-sectional views, taken along sections 3—3 and 4—4, respectively, of FIG. 1;

FIG. 5 is an enlarged fragmentary view showing the relationship of the knobs and ribs formed on the frame walls;

FIGS. 6 and 7 are views like those of FIGS. 3 and 4, but of an alternative embodiment of the invention; and FIGS. 8 and 9 are cross-sectional illustrations taken from section 8—8 of FIG. 7, and section 9—9 of FIG. 6, respectively.

As shown in FIGS. 1 through 5, the form for a mortar cap 10 comprises a base frame 12 set within an ancillary frame 14. The base frame 12 has parallel, spaced-apart walls 16 and 18, 20 and 22, 24 and 26, and 28 and 30 which are joined, and fixed in the spaced-apart disposition, by ligaments 32. The ancillary frame 14 also has parallel, spaced-apart walls 34 and 36, 38 and 40, 42 and 44, and 46 and 48, which are joined, and fixed in the spaced-apart disposition, by limbs 50.

The limbs 50 bridge across the tops of the walls of the ancillary frame, whereas the ligaments 32 traverse the channels of the base frame 12. Each of the ligaments 32 has an opening 52 formed therein to accommodate for the flow, through the channels, of fluid cementitious materials.

The ancillary frame 14 is slidably engaged with the base frame 12 and can be raised, vertically, to increase the depth of the mortar cap form 10. Too, alternatively, an end, or side, or corner of the ancillary frame 14 can be raised, relative to the base frame 12, to accommodate for a slope, an angle or a tilt. Too, the invention comprehends means for arresting the ancillary frame in its vertically raised, angled, sloped or tilted disposition vis-a-vis the base frame 12.

The outermost walls 18, 22, 26 and 28 have surfaces which confront the outermost walls 34, 40, 42 and 48. Those of the ancillary frame, i.e. 34, 40, 42, 48, have at the base thereof, in a plurality of locations, knobs 54 of hemispheric cross-section. Correspondingly, the confronting surfaces of the walls 18, 22, 26, and 28, of the base frame 12 have racks of parallel, spaced-apart ribs of semi-circular cross-section, denoted by the index number 56. Now, as the ancillary frame 14 is elevated, or has an end raised, or a side lifted, or a corner elevated relative to the base frame 12, the knobs 54 and ribs 56 interfere with each other. The knobs 54 must be forced up over the ribs 56. However, once an end, corner, or side of the ancillary frame 14 is forced to some chosen displacement, relative to the base frame 12, there it remains. The interfering knobs 54 and ribs 56 arrest the ancillary frame in the displaced disposition. In this way, then, the depth of the mortar cap form 10, as shown in FIGS. 2 and 5, in phantom, can be adjusted, and any desired angle, slope or tilt of the footing to be formed can be accommodated by the single article, the dual-frame mortar cap form 10.

In an alternative embodiment **10*a*, the ancillary frame 14*a*, FIG. 6, can have a plurality of fine, "nail" holes formed in the base thereof, as shown by the index number 58, and the confronting wall of the base frame 12*a*, FIG. 7, can have racks of slits 60. Then, by aligning holes 58 with chosen slits 60, and setting nails or rods or the like therein, the ancillary frame 14*a* can likewise be arrested in any chosen displacement relative to the base frame 12*a***.

While I have described my invention in connection with specific embodiments thereof, it is to be clearly understood that this is done only by way of example, and not as a limitation to the scope of my invention as set forth in the objects thereof and in the appended claims.

We claim:

1. A form for a mortar cap, for receiving cementitious materials therewithin, such as cement, mortar, and the like, to define a footing for a catch basis grating, comprising:

a base frame having parallel, spaced-apart walls; and an ancillary frame also having parallel, spaced-apart walls; wherein said base frame is set within said ancillary frame;

said ancillary frame is slidably and vertically displaceable relative to said base frame;

said base frame has a plurality of ligaments joining said walls thereof, and fixing said walls thereof in said spaced-apart disposition; and said ligaments have openings formed therein to accommodate a flow therethrough of cementitious materials.

2. A form for a mortar cap, for receiving cementitious materials therewithin, such as cement, mortar, and the like, to define a footing for a catch basin grating, comprising:

a base frame having parallel, spaced-apart walls; and an ancillary frame also having parallel, spaced-apart walls; wherein said base frame is set within said ancillary frame;

said ancillary is slidably and vertically displaceable relative to said base frame;

said walls of said base frame and said walls of said ancillary frame have mutually confronting surfaces; and given ones of said surfaces have means for arresting said ancillary frame at selected, vertical displacements thereof relative to said base frame.

3. A form for a mortar cap, according to claim 2, wherein:

said ancillary frame has a bottom and a top; and said limbs bridge between said walls of said ancillary frame across said top thereof.

4. A form for a mortar cap, according to claim 2, wherein:

said base frame has a plurality of ligaments joining said walls thereof, and fixing said walls thereof in said spaced-apart disposition.

5. A form for a mortar cap, according to claim 2, wherein:

said ancillary frame has a plurality of limbs joining said walls thereof, and fixing said walls thereof in said spaced-apart disposition.

6. A form for a mortar cap, according to claim 2, wherein:

said frames are rectilinear, each thereof having a pair of sides joined by a pair of ends at substantially right-angular corners; and said arresting means comprises means for arrestingly disposing a side of said ancillary frame in a given vertical displacement relative to said main frame.

7. A form for a mortar cap, according to claim 2, wherein:

said frames are rectilinear, each thereof having a pair of sides joined by a pair of ends at substantially right-angular corners; and said arresting means comprises means for arrestingly disposing an end of said ancillary frame in a given vertical displacement relative to said main frame.

8. A form for a mortar cap, according to claim 2, wherein:

said frames are rectilinear, each thereof having a pair of sides joined by a pair of ends at substantially right-angular corners; and said arresting means comprises means for arrestingly disposing a corner of said ancillary frame in a given vertical displacement relative to said main frame.

9. A form for a mortar cap, according to claim 2, wherein:

said arresting means comprises knobs projecting from walls of said ancillary frame, and ribs projecting from walls of said main frame.

10. A form for a mortar cap, according to claim 2, wherein:

said arresting means comprises fine holes formed in said walls of said ancillary frame, and fine slits formed in said walls of said main frame.

* * * * *